US006172646B1

(12) United States Patent
Kawahata et al.

(10) Patent No.: US 6,172,646 B1
(45) Date of Patent: Jan. 9, 2001

(54) ANTENNA APPARATUS AND COMMUNICATION APPARATUS USING THE ANTENNA APPARATUS

(75) Inventors: Kazunari Kawahata, Machida; Ken Okada; Atsuyuki Yuasa, both of Yokohama; Shoji Nagumo, Kawasaki; Junichi Kurita, Ishikawa-ken, all of (JP)

(73) Assignee: Murata Manufacturing Co., Ltd. (JP)

( * ) Notice: Under 35 U.S.C. 154(b), the term of this patent shall be extended for 0 days.

(21) Appl. No.: 09/416,111

(22) Filed: Oct. 4, 1999

(30) Foreign Application Priority Data

Mar. 15, 1999 (JP) ..... 11-068349

(51) Int. Cl.[7] ..... H01Q 1/24
(52) U.S. Cl. ..... 343/702; 455/575; 455/90
(58) Field of Search ..... 343/702, 700 MS, 343/725; 455/575, 90

(56) References Cited

U.S. PATENT DOCUMENTS 4,975,711 * 12/1990 Lee ..... 343/702
5,861,854 * 1/1999 Kawahata et al. ..... 343/702
5,943,019 * 8/1999 Kawahata et al. ..... 343/702

* cited by examiner

*Primary Examiner*—Don Wong
*Assistant Examiner*—James Clinger
(74) *Attorney, Agent, or Firm*—Ostrolenk, Faber, Gerb & Soffen, LLP

(57) ABSTRACT

An antenna apparatus has improved gain, and its characteristics are barely affected by changes in the external environment in which it used, such as when it is placed close to a ground conductor. A surface-mount antenna and a monopole antenna are fed by a single feeding point, and the direction of an open end of the surface-mount antenna, taking a ground end of a radiation electrode as a reference, runs opposite to the direction of the open end of the monopole antenna, taking the feeding terminal as a reference.

8 Claims, 7 Drawing Sheets

ANTENNA APPARATUS AND COMMUNICATION APPARATUS USING THE ANTENNA APPARATUS

BACKGROUND OF THE INVENTION

1. Field of the Invention

The present invention relates to an antenna apparatus and a communication apparatus using the antenna apparatus, and more particularly relates to an antenna apparatus used in a mobile communication apparatus, and a communication apparatus using the antenna apparatus.

2. Description of the Related Art

Recently, amid advances in high-performance mobile telephones such as PHS, there are demands to provide a mobile communication apparatus wherein an antenna mounted thereon has even higher performance characteristics, such as high gain and a capability to be miniturized.

FIG. 6 shows a conventional antenna apparatus mounted on a mobile communication apparatus. In FIG. 6, an antenna apparatus 1 comprises a ground electrode 3 provided on one major surface 2*a* of a mount substrate 2, the corner of the major surface 2*a* having a removed portion 3*a,* a supply wire 4 provided in the removed portion 3*a,* and a surface-mount antenna 5 mounted thereabove. Then, the supply wire 4 is connected to a supply terminal (not shown in the diagram) of the surface-mount antenna 5, and also to a signal source 6 provided on the mount substrate 2.

FIG. 7 shows the surface-mount antenna 5 in more detail. The surface-mount antenna 5 has the basic constitution of that disclosed in Japan Unexamined Patent Publication No. 10-13139.

In FIG. 7, the surface-mount antenna 5 comprises several electrodes provided on the surface of a rectangular substrate 10, which comprises an insulating dielectric such as ceramic or resin. Firstly, a strip-shaped radiation electrode 11 is provided extending from the other major surface 10*b* of the substrate 10, across one end face 10*d,* and returning once again to the other major surface 10*b*. One end of the radiation electrode 11 is an open end 11*a,* and the other end connects to a first ground terminal 12, which extends from an end face 10*c* of the substrate 10 to a first major surface 10*a* thereof. Furthermore, a feeding electrode 13 is isolated from the radiation electrode 11 and is provided on a second major surface 10*b* of the substrate 10. One end of the feeding electrode 13 connects to a feeder terminal 14, which extends from the end face 10*c* of the substrate 10 to the first major surface 10*a* thereof. Similarly, a ground electrode 15 is provided on the other major surface 10*b* of the substrate 10 near the open end 11*a* of the radiation electrode 11. One end of the ground electrode 15 is connected to a second ground terminal 16, which extends from the end face 10*c* of the substrate 10 to the first major surface 10*a*. Furthermore, terminals for securing 17 and 18 are provided on the first major surface 10*a* of the substrate 10, and connect to the radiation electrode 11.

When the surface-mount antenna 5 is mounted on a mount substrate (not shown in the diagram), the five electrodes comprising the first and second ground terminals 12 and 16, the feeder terminal 14, and the terminal for securing 17 and 18, are connected by soldering to ground electrodes, supply lines, and electrodes for securing on the mount substrate side. Therefore, the five electrodes are represented as terminals in order to distinguish them from these other electrodes.

In a surface-mount antenna 5 having such a constitution, when a high-frequency signal is input to the feeder terminal 14, the high-frequency signal is transmitted to the radiation electrode 11 via a capacitance created between the open end 11*a* of the radiation electrode 11 and the feeding electrode 13. The radiation electrode 11 is made to resonate by the inductance component of the radiation electrode 11 itself, and by the capacitance formed between the open end 11*a* of the radiation electrode 11 and the feeding electrode 13. The surface-mount antenna 5 functions as an antenna by radiating a portion of the resonance energy into space as electric waves.

At this point, since one end of the radiation electrode 11 is an open end 11*a,* and the other end is a grounded end, the resonance is approximately one-quarter wavelength. A current 19 flowing to the radiation electrode 11 (i.e. the current flowing to the surface-mount antenna 5) flows from the grounded end of the radiation electrode 11 (more specifically, the first ground terminal 12) toward the open end 11*a*. As a result, magnetic field components of the electric waves radiated from the surface-mount antenna 5, and the electric waves received by the surface-mount antenna 5, vibrate mainly in the direction of the 2 axis of the coordinates shown in FIG. 7.

The electrodes and terminals of the surface-mount antenna 5 are provided separately from each other, but it is not absolutely necessary for them to be separated by some kind of clear boundary. The electrodes and the terminals may acceptably be provided together.

In the antenna apparatus 1 shown in FIG. 6, when the current 19 flows to the surface-mount antenna 5, an image current 7 which is 180 degrees out of phase with the current 19 flows mainly to the ground electrode 3.

However, when the antenna apparatus 1 is used, the mount substrate 2 is covered by a case of plastic, metal, or the like. The case is often left in such places as on a shelf, or in a bag. When placed on a shelf or in a bag, the case often comes into close contact with conductive objects comprising metal and the like, and such objects function more or less like ground conductors. This leads to a problem that, depending on the external environment in which this type of antenna apparatus 1 is used, the ground conductors in close proximity thereto alter the direction and position of the flow of the image current 7 of the current 19 flowing to the surface-mount antenna 5, affecting the characteristics of the antenna apparatus 1 such as its gain and directivity.

SUMMARY OF THE INVENTION

To overcome the above described problems, preferred embodiments of the present invention provide an antenna apparatus having higher gain and characteristics which are largely unaffected by the external environment in which the antenna apparatus is used, and a communication apparatus using the antenna apparatus.

One preferred embodiment of the present invention provides an antenna apparatus comprising a strip-shaped radiation electrode having one open end and one grounded end, a surface-mount antenna comprising a feeding electrode isolated from the radiation electrode, and a monopole antenna disposed in the vicinity of the surface-mount antenna. The radiation electrode, the surface-mount antenna, and the monopole antenna are provided on the surface of a base comprising an insulator. In addition, the surface-mount antenna and the monopole antenna are fed from a single feeding point, and are arranged so that an image current of current flowing to the surface-mount antenna flows to the monopole antenna, and an image current of current flowing to the monopole antenna flows to the surface-mount antenna.

Furthermore, the antenna apparatus of the present invention comprises a strip-shaped radiation electrode having one open end and one grounded end, a surface-mount antenna comprising a feeding electrode isolated from the radiation electrode, and a monopole antenna disposed in the vicinity of the surface-mount antenna. The radiation electrode, the surface-mount antenna, and the monopole antenna are provided on the surface of a base comprising an insulator. The surface-mount antenna and the monopole antenna are fed from a single feeding point. In addition, the direction of the open end of the surface-mount antenna, taking a ground end of the radiation electrode as a reference, runs opposite to the direction of the open end of the monopole antenna, taking the feeding point as a reference.

Preferably, the electrical length of the monopole antenna is between one-eighth and one-quarter of the wavelength of the frequency used by the antenna apparatus.

Furthermore, a communication apparatus of the present invention uses any of the antenna apparatuss described above.

According to such a constitution, the gain of the antenna apparatus of the present invention can be improved. Further, changes in the characteristics of the antenna apparatus, which are caused by the place where it is positioned, can be reduced.

Furthermore, the communication apparatus of the present invention can achieve better characteristics.

DESCRIPTION OF THE PREFERRED EMBODIMENTS

Figure 1A:
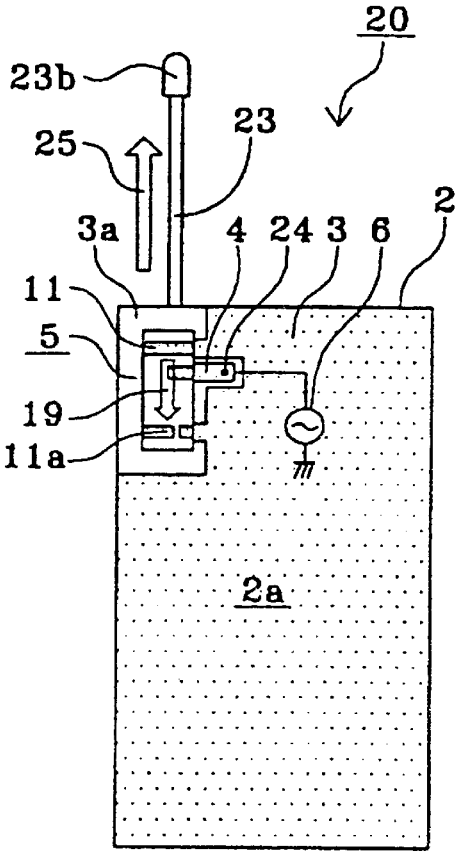
FIGS. 1A and 1B are diagrams showing an embodiment of the antenna apparatus of the present invention.
Figure 1B:
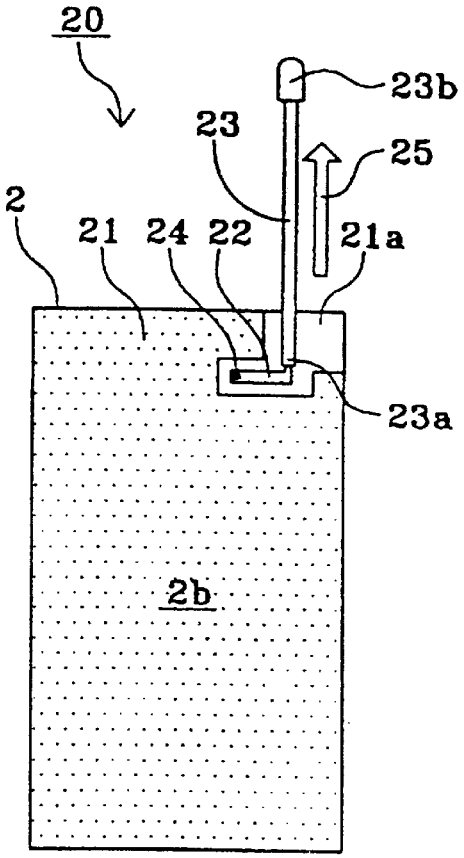
Figure 6:
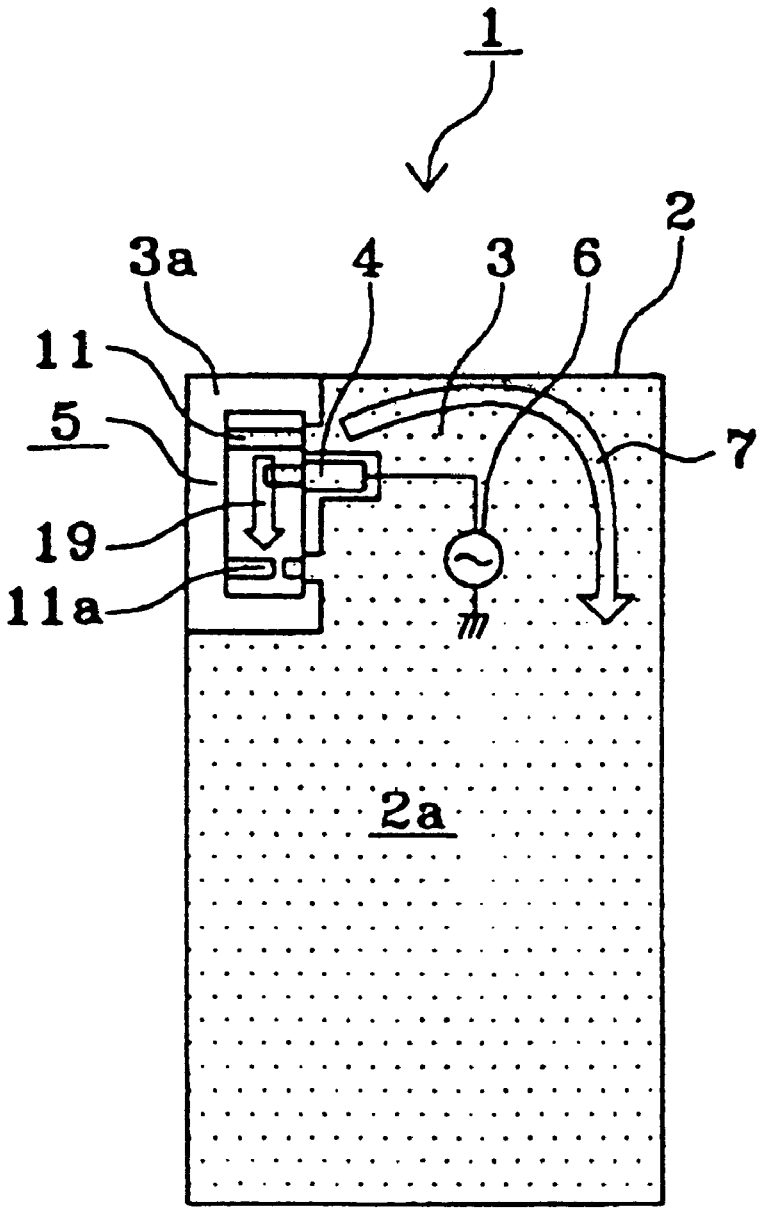
FIG. 6 is a diagram showing a conventional antenna apparatus.
Figure 7:
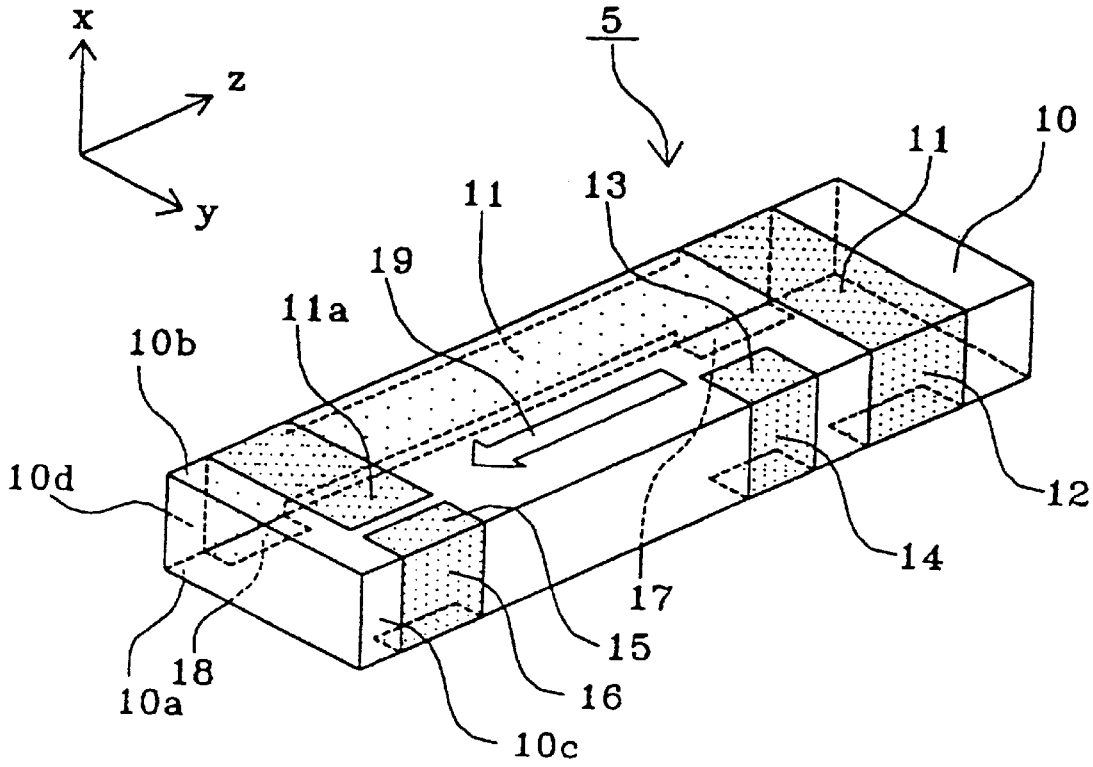
FIG. 7 is a perspective view of a surface-mount antenna used in the antenna apparatus of FIG. 6.

FIGS. 1A and 1B show an embodiment of the antenna apparatus of the present invention. Here, 1A is a view from a first major surface 2*a* of a mount substrate 2, and FIG. 1B is a view from a second major surface 2*b* of the mount substrate 2. In FIGS. 1A and 1B, portions identical to those in FIG. 6 and FIG. 7 are represented by the same reference numerals, and further explanation thereof is omitted.

In the antenna apparatus 20 shown in FIGS. 1A and 1B, a ground electrode 21 is provided on the second major surface 2*b* of the mount substrate 2, a feeder wire 22 is provided in a removed portion 21*a* of the ground electrode 21 at the corner of the second major surface 2*b* of the mount substrate 2, and a monopole antenna 23 is mounted thereon. A feeder end 23*a* of the monopole antenna 23 connects to the feeder wire 22. A feeder wire 4 is provided on the first major surface 2*a* of the mount substrate 2, and is connected by a through hole 24 to the feeder wire 22 provided on the second major surface 2*b* of the mount substrate 2. Here, since the feeder wire 4 is connected to a signal source 6, the surface-mount antenna 5 and the monopole antenna 23 are both supplied by the same feeder point. Furthermore, the surface-mount antenna 5 and the monopole antenna 23 are provided so that the direction of the open end 11*a* of the radiation electrode 11, taking as a reference the grounded end of the radiation electrode 11 of the surface-mount antenna 5, is opposite to the direction of the open end 23*b* of the monopole antenna 23, taking as a reference the feeder end 23*a*.

In the antenna apparatus 20 of such a constitution, when a current 19 flows to the surface-mount antenna 5, a current 25 also flows to the monopole antenna 23 which is fed simultaneously. Then, since the surface-mount antenna 5 is fed via a capacitance formed between the feeding electrode 13 and the open end 11*a* of the radiation electrode 11, and the monopole antenna 23 is fed directly at its feeder end 23*a*, the currents flowing to the surface-mount antenna 5 and the monopole antenna 23 are in reverse phase to each other.

Taking the surface-mount antenna 5 as a reference, the image current of the current 19 flowing to the surface-mount antenna 5 has the same direction and phase as the current 25 flowing to the monopole antenna 23. Consequently, most of the image current of the current 25 flowing to the surface-mount antenna 5 flows to the monopole antenna 23, and not to the ground electrode 3.

Conversely, taking the monopole antenna 23 as a reference, when operating in devices, the image current of the monopole antenna 23, which ought to flow to the ground electrode 21, has the same direction and phase as the current 19 flowing to the surface-mount antenna 5. As a consequence, most of the image current of the current 25 flowing to the monopole antenna 23 flows to the surface-mount antenna 5, and not to the ground electrode 21.

In this way, most of the image current of the current 19 flowing to the surface-mount antenna 5 and the image current of the current 25 flowing to the monopole antenna 23 do not flow to the ground electrode 21 or the ground electrode 3 of the mount substrate 2. As a result, even when the antenna apparatus 20 is covered with a case of plastic or the like and used in a variety of external environments, there is no change in the position and direction of the flow of the image current of the current fed to the surface-mount antenna 5 and the monopole antenna 23, whereby the problem of changes in the characteristics of the antenna apparatus 20 is almost completely eliminated.

Figure 2A:
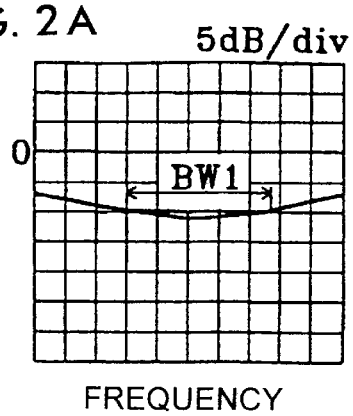
FIGS. 2A to 2F are diagrams showing reflection loss and directivity of the antenna apparatus of the present invention.
Figure 2B:
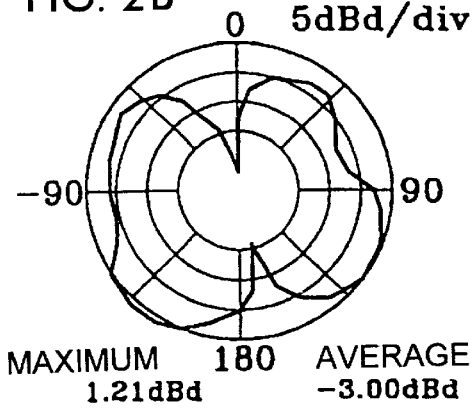
Figure 2C:
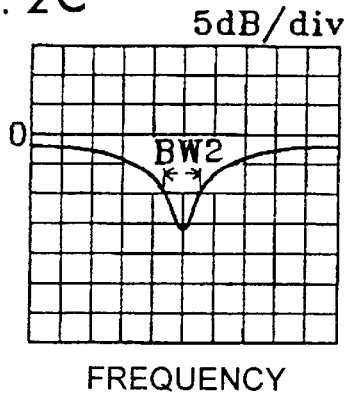
Figure 2D:
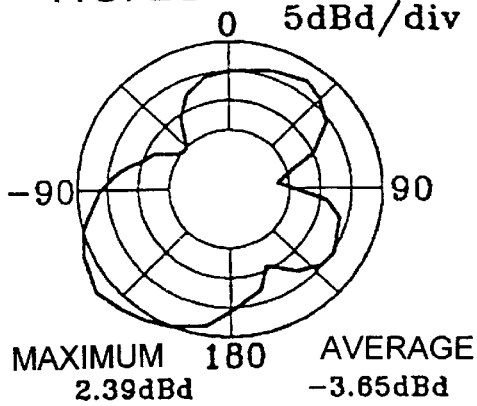
Figure 2E:
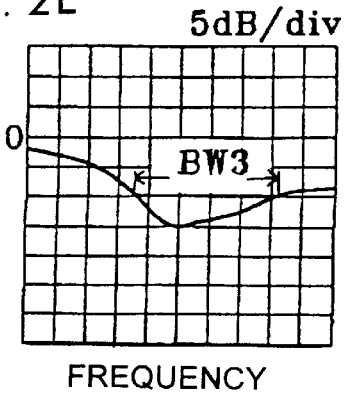
Figure 2F:
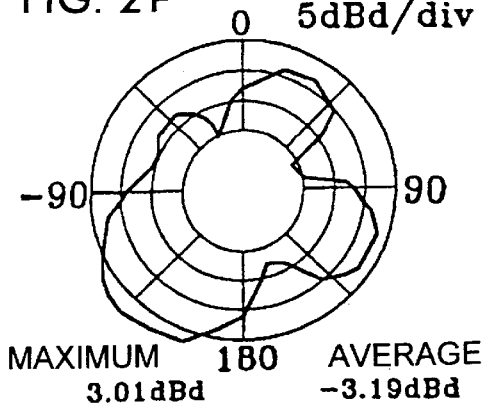

FIGS. 2A to 2F show directivity of gain and reflection loss of the antenna apparatus 20 of the present invention, in comparison with an antenna apparatus wherein only the monopole antenna is mounted, and an antenna apparatus wherein only the surface-mount antenna is mounted. Here, FIG. 2A shows reflection loss of the antenna apparatus when only the monopole antenna is mounted, FIG. 2B shows directivity of gain in the same antenna apparatus, FIG. 2C shows reflection loss of the antenna apparatus when only the surface-mount antenna is mounted, FIG. 2D shows directivity of gain in the same antenna apparatus, FIG. 2E shows reflection loss of the antenna apparatus 20 of the present invention, and FIG. 2F shows directivity of gain in the same. In FIGS. 2A, 2C, and 2E, symbols BW1, BW2, and BW3 represent bandwidths (frequency bandwidths in which reflection loss is below −9.5 dB) of the antenna apparatus.

As can be understood from FIGS. 2A to 2F, the bandwidth of the antenna apparatus of the present invention does not have the overall balance achieved when only the monopole antenna is mounted, but a wider bandwidth is achieved than when only the surface-mount antenna is mounted, especially on the high frequency side. Furthermore, as regards directivity, the null points which appear near 0 degrees and 180 degrees when only the monopole antenna is mounted can be compensated by the directivity of the surface-mount antenna, and thereby eliminated. Moreover, although the average gain of the antenna apparatus of the present invention is −3.19 dBd, this being between the average values when only the monopole antenna is mounted (−3.00 dBd) and when only the surface-mount antenna is mounted (−3.65 dBd), the maximum value of gain in the antenna apparatus of the present invention is 3.01 dBd, which exceeds the maximum values of the other cases (1.21 dBd and 2.38 dBd respectively).

In this way, by combining the surface-mount antenna and the monopole antenna, supplying them from a single feeding point, and arranging them so that the direction from the grounded end of the radiation electrode of the surface-mount antenna to the open end thereof is opposite to the direction from the feeding point of the monopole antenna to the open end, it is possible to improve the bandwidth and the gain of both antennas.

Figure 3:
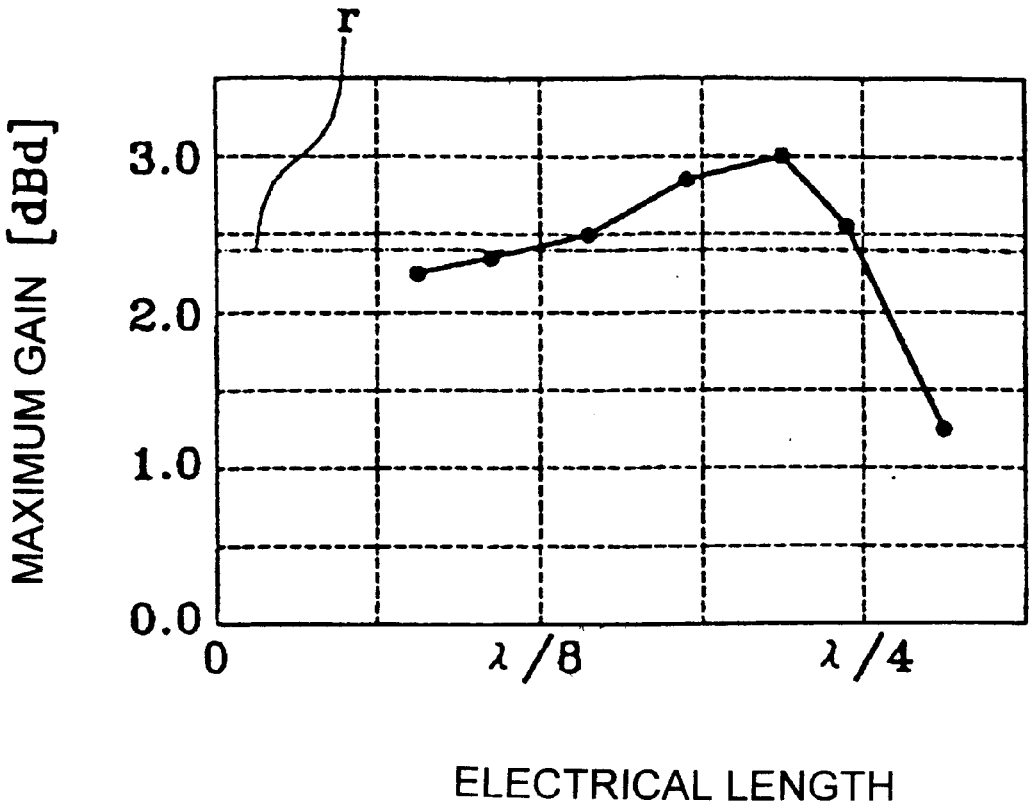
FIG. 3 is a diagram showing the relationship between electrical length and maximum gain of a monopole antenna of the antenna apparatus of the present invention.

FIG. 3 shows changes in the maximum gain when the electrical length of the monopole antenna 23 of the antenna apparatus 20 is changed. Here, a reference line r represents the maximum gain of the antenna apparatus 20 when only the surface-mount antenna 5 is mounted.

According to FIG. 3, when the electrical length of the monopole antenna 23 is one-eighth of the wavelength to one-quarter of the wavelength, the maximum gain exceeds the reference line r. As a consequence, in the antenna apparatus 20 of the present invention, by setting the electrical length of the monopole antenna 23 to between one-eighth eighth and one-quarter of the wavelength, higher gain can be achieved than when only the surface-mount antenna 5 is mounted.

Figure 4A:
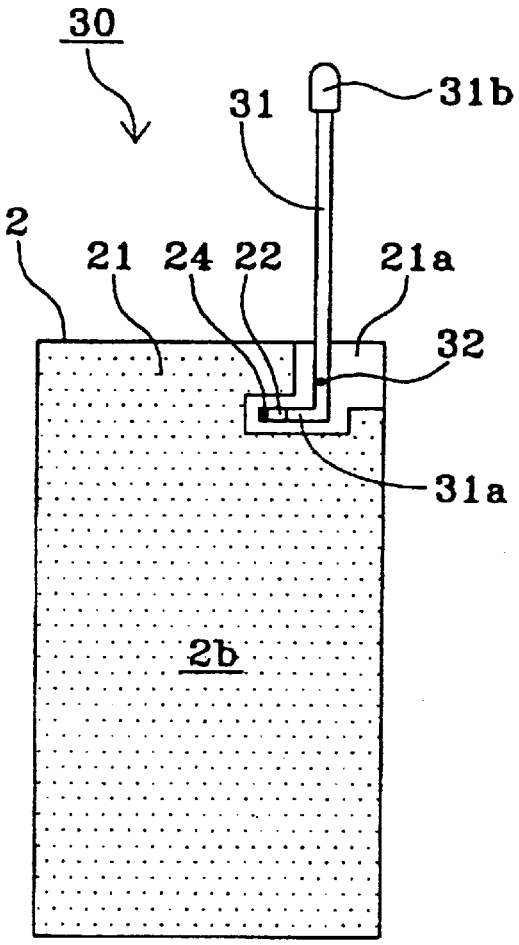
FIGS. 4A and 4B are diagrams showing another embodiment of the antenna apparatus of the present invention.
Figure 4B:
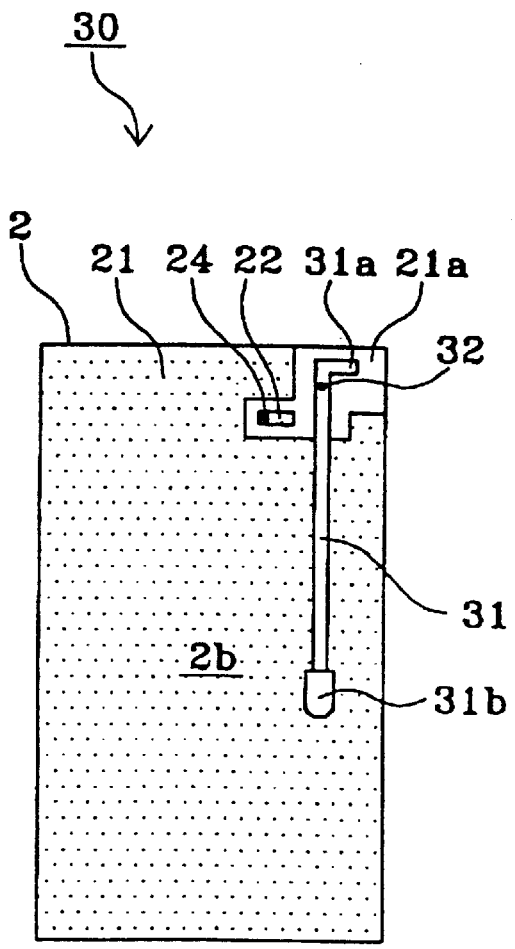

FIGS. 4A and 4B show another embodiment of the antenna apparatus of the present invention. In FIGS. 4A and 4B, since the view from the first major surface 2*a* of the mount substrate 2 is the same as FIG. 1, only a view from the second major surface 2*b* is the same as FIG. 1, only a view from the second major surface 2*b* of the mount substrate 2 is shown. Furthermore, portions identical to those in FIG. 1 are represented by the same reference numerals, and further explanation thereof is omitted.

In FIGS. 4A and 4B, a monopole antenna 31 of the fs antenna apparatus 30 is able to rotate 180 degrees around an axis of rotation 32. Here, FIG. 4A shows the monopole antenna 31 protruding from the mount substrate 2 (i.e. the case), and FIG. 4B shows the monopole antenna 31 stored in the mount substrate 2 (i.e. the case). When the monopole antenna 31 is protruding, the feeder end 31*a* of the monopole antenna 31 connects to the feeder wire 22.

According to this constitution, the monopole antenna 31 of the antenna apparatus 30 does not function when it is stored (on standby in the case of a mobile telephone), and only the surface-mount antenna 5 functions as an antenna apparatus. Then, when the monopole antenna 31 is pulled out to the protruding position (when making a call in the case of a mobile telephone), the antenna apparatus 30 functions as an antenna apparatus combining the monopole antenna 31 and the surface-mount antenna 5.

When the surface-mount antenna 5 and the monopole antenna 31 are combined in this way to form the antenna apparatus 30, since the monopole antenna 31 is stored when for instance the mobile telephone is on standby, the monopole antenna 31 will suffer no damage even if the antenna apparatus 30 is dropped or mishandled.

The monopole antenna can be stored by methods other than rotation, such as extension, folding, etc.

In the embodiments described above, the base of the surface-mount antenna 5 comprises an insulating dielectric such as ceramic or resin, but a magnetic body having similar insulating characteristics may be used instead.

Furthermore, the monopole antenna is not restricted to the rectangular antenna shown in FIGS. 1A and 1B, and FIGS. 4A and 4B. A monopole antenna of another shape may be used, such as a helical antenna comprising a radiation conductor twisted into a spiral, or an antenna combining a rectangular antenna with a helical antenna.

Figure 5:
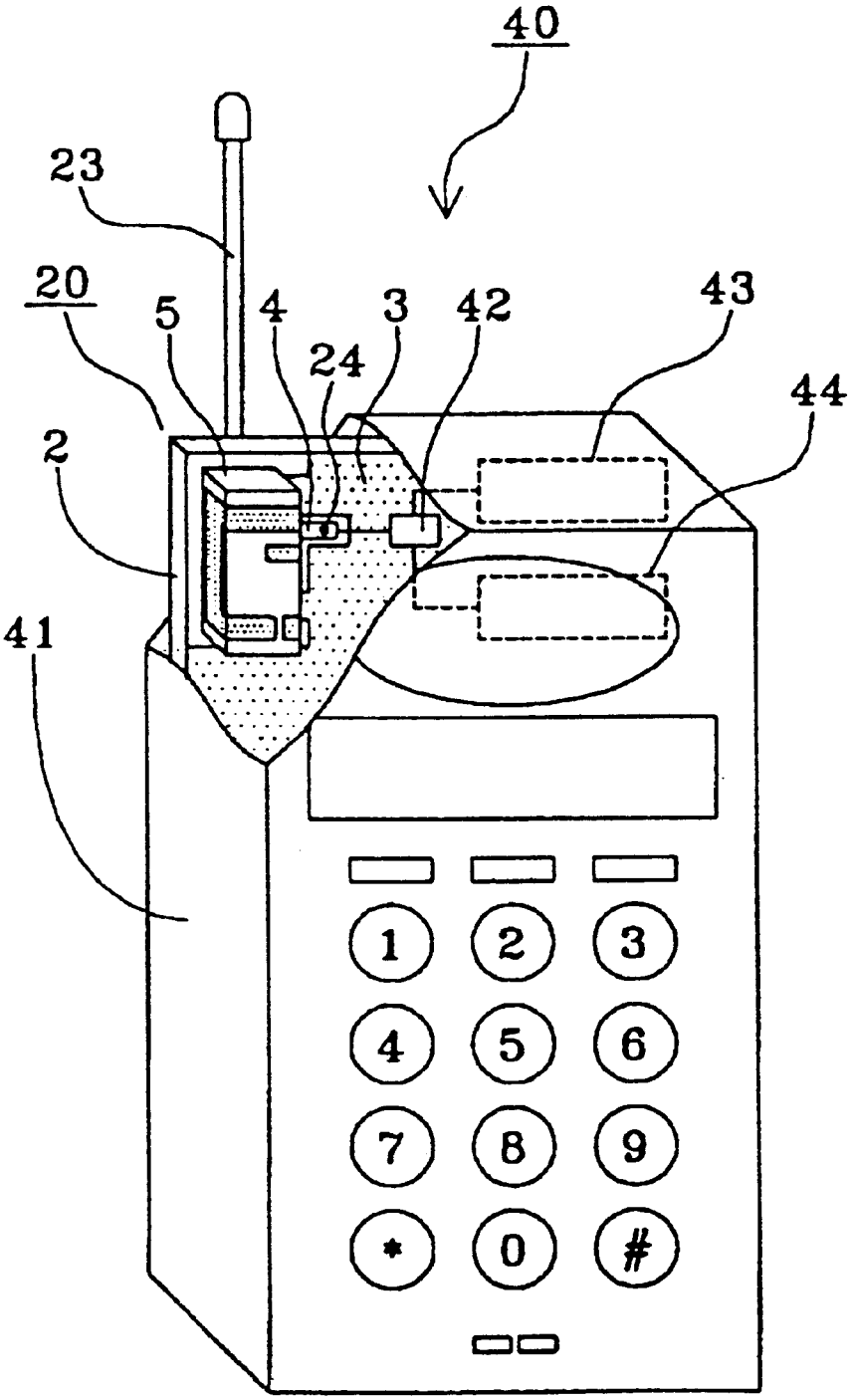
FIG. 5 is a perspective view of an embodiment of a communication apparatus of the present invention.

FIG. 5 shows an embodiment of a communication apparatus which uses the antenna apparatus 20 of the present invention. In FIG. 5, the communication apparatus 40 comprises the antenna apparatus 20 provided in a case 41. A feeder wire 4 is provided on the mount substrate 2 of the antenna apparatus 20, and is connected to a transmitter 43 and a receiver 44 via a switch 42, similarly provided on the mount substrate 2.

By using the antenna apparatus 20 to form the communication apparatus 40 in this way, the bandwidth of the communication apparatus 40 can be widened, and its gain can be increased. Furthermore, since most of the image current of current flowing to the monopole antenna 23 and to the surface-mount antenna 5 mounted on the antenna apparatus 20 does not flow to the case 41 of the communication apparatus 40 or to the ground electrode 3 of the mount substrate 2, the antenna characteristics are not affected by changes in the external environment which the communication apparatus 40 is used in.

According to the antenna apparatus of the present invention, a strip-shaped radiation electrode having an open end and a grounded end, a surface-mount antenna comprising a feeding electrode isolated from said radiation electrode, and a monopole antenna, are fed from a single feeding point, and are provided on a surface of a base comprising an insulator so that the direction of the open end of the surface-mount antenna, taking the ground end of the radiation electrode as a reference, runs opposite to the direction of the open end of the monopole antenna, taking the feeding point as a reference. As a result, the image current of the current flowing to the surface-mount antenna can flow to the monopole antenna, and the image current of the current flowing to the monopole antenna can flow to the surface-mount antenna, so that most of the image current flows to the ground electrode. Consequently, it is possible to prevent the characteristics of the antenna apparatus from being affected by changes in the external environment in which it is used. Furthermore, the bandwidth and gain of the antenna apparatus can both be improved.

Furthermore, by setting the electrical length of the monopole antenna to between one-eighth and one-quarter of the wavelength, the gain of the antenna apparatus can be increased to more than when only the surface-mount antenna is mounted.

Moreover, when the antenna apparatus of the present invention is used in a communication apparatus, the bandwidth of the communication apparatus is wider, and gain is improved. Furthermore, it is possible to prevent the characteristics of the communication apparatus from being affected by changes in the external environment in which it is used.

What is claimed is:

1. An antenna apparatus comprising: a strip-shaped radiation electrode having one open end and one grounded end; a surface-mount antenna comprising a feeding electrode isolated from said radiation electrode; and a monopole antenna disposed in the vicinity of said surface-mount antenna; the radiation electrode, the surface-mount antenna, and the monopole antenna being provided on a surface of a base comprising an insulator;

said surface-mount antenna and said monopole antenna being fed from a single feeding point, and being arranged so that an image current of current flowing to said surface-mount antenna flows to said monopole antenna, and an image current of current flowing to said monopole antenna flows to said surface-mount antenna.

2. An antenna apparatus comprising: a strip-shaped radiation electrode having one open end and one grounded end; a surface-mount antenna comprising a feeding electrode isolated from said radiation electrode; and a monopole antenna disposed in the vicinity of said surface-mount antenna; the radiation electrode, the surface-mount antenna, and the monopole antenna being provided on a surface of a base comprising an insulator;

said surface-mount antenna and said monopole antenna each having an open end and being fed from a single feeding point, and a direction of said open end of said surface-mount antenna, taking the grounded end of the radiation electrode as a reference, being opposite to the direction of the open end of the monopole antenna, taking the feeding point as a reference.

3. The antenna apparatus according to claim 1, wherein the electrical length of said monopole antenna is between one-eighth and one-quarter of the wavelength of the frequency used.

4. The antenna apparatus according to claim 2, wherein the electrical length of said monopole antenna is between one-eighth and one-quarter of the wavelength of the frequency used.

5. A communication apparatus including the antenna apparatus according to claim 1.

6. A communication apparatus including the antenna apparatus according to claim 2.

7. A communication apparatus including the antenna apparatus according to claim 3.

8. A communication apparatus including the antenna apparatus according to claim 4.

* * * * *